US005407196A

United States Patent [19]

Busnardo

[11] Patent Number: 5,407,196

[45] Date of Patent: Apr. 18, 1995

[54] ADJUSTABLE GOLF PUTTER

[76] Inventor: Romolo Busnardo, 1320 Ruth Ln., Nampa, Id. 83686

[21] Appl. No.: 288,288

[22] Filed: Aug. 10, 1994

[51] Int. Cl.[6] ..... A63B 53/04

[52] U.S. Cl. ..... 273/78; 273/167 B; 273/173

[58] Field of Search ..... 273/77 R, 78, 79, 173, 273/167 J, 80.1, 80.2, 80 C, 167 G, 167 R, 167 H, 162 R, DIG. 23, DIG. 8, 186.2, 187.4, 169, 167 F, 167 B, 168

[56] References Cited

U.S. PATENT DOCUMENTS

| | | | |
|---|---|---|---|
| 1,968,626 | 7/1934 | Young | 273/78 |
| 3,211,455 | 10/1965 | Hyden | 273/78 |
| 3,843,122 | 10/1974 | Florian | 273/167 R |
| 4,113,249 | 9/1978 | Beery | 273/78 |
| 4,795,158 | 1/1989 | Fuykendall | 273/167 B |
| 4,921,253 | 6/1990 | Tesori | 273/167 B |
| 5,246,227 | 9/1993 | Sun | 273/78 |
| 5,253,869 | 10/1993 | Dingle | 273/80.1 |
| 5,269,517 | 12/1993 | Petrucelli | 273/78 |

OTHER PUBLICATIONS

Article "A Putter's Dozen", p. 200, from Today's Golfer.

*Primary Examiner*—Sebastiano Passaniti
*Attorney, Agent, or Firm*—Frank J. Dykas

[57] ABSTRACT

An adjustable golf putter 10 is provided with a putter head body 20 together with removable face plate assembly 22. Face plate assembly 22 is formed of metal plate 36 encased within bonded rubber 38. Face plate assembly 22 has formed integral with bonded rubber a striking surface, 46 or 48, of preselected loft angle. Hosel 14 interconnects shaft 16 to putter head assembly 12 and is provided with an adjustable attachment mechanism which enables adjustment from left to right handed operation, as well as for the lie of the club.

9 Claims, 5 Drawing Sheets

ADJUSTABLE GOLF PUTTER

BACKGROUND OF THE INVENTION

1. Technical Field

This invention relates in general to golf clubs, and more particularly to an adjustable putter which is adjustable for weight, left or right handed operation, positive or negative loft, lie, and which also incorporates an adjustable mass, resilient rubber striking face.

1. Background

No club in the golfer's ensemble of clubs is used more often than a putter. A typical round of golf involves 18 holes of play. A par round of golf for most courses constitutes 72 strokes. "Regulation" golf usually involves a drive, a second shot on to the green, and two putts. That being the case, 36 strokes in a typical par round of golf will be putts. Of course, for most golfers the putter will be used even more often depending on the golfer's ability.

This being the case, in is no wonder that so much attention is focused on the putting aspect of the game. Golfers often appear obsessed with their putters, and many golfers are known to have more than one if not many putters which they have used from time to time in the search for the perfect putter.

Putters have been constructed of a variety of materials and have exhibited a multitude of designs. Conventional putting "wisdom", demonstrated by the majority of these designs, teaches that a golf putter typically has a metal head having a face with a positive loft of several degrees. In a recent article appearing in TODAY'S GOLFER, the author claims that loft on a putter is needed to aid roll. See TODAY'S GOLFER, July, 1994, "A Putter's Dozen", page 200.

Most putters do, in fact, have several degrees of loft. When a ball is putted it moves across the green initially by sliding. As the frictional forces of the green cause the spin rate of the ball to increase, the ball eventually stops sliding and begins to spin or roll. It is while the ball is rolling that the putt has the greatest amount of directional stability due primarily to the inertia created by the rolling ball.

Therefore, it would follow that the sooner the ball begins to roll, the greater the control that the player will have over his putt. It is particularly true on very well kept greens. By using a putter having a negative loft, top spin is imparted on the ball when struck, increasing the tendency of the ball to roll rather than slide.

Nevertheless, at times the player would be advantaged if the putter did in fact have several degrees of positive loft, for example, when playing off a fringe or when playing long putts or putts on greens which are not so well kept. In these instances a few degrees of positive loft may be beneficial for moving the ball nearer the hole.

Accordingly, it would be of benefit to the experienced putter to be able to interchange between a positive loft and a negative loft striking face, depending upon course and play conditions.

In addition, it would be advantageous to incorporate other features into the putter which enable the golfer to adjust the putter to the golfer's particular needs. These include an adjustable lie, wherein the angle of inclination at which the club shaft and attached hosel intersect with the head assembly can be adjusted between a more upright, or vertical/perpendicular angle of engagement to a flatter lie. Other adjustments would include adjustable shaft lengths, and weight of the putter.

In the prior art, putters are typically constructed of metal, either cast or forged. Additionally, in the prior art, no adjustments or modifications are made to control rebounding of the golf ball off of the hard face of the putter.

Accordingly, among the objectives of the present invention are to provide a golf putter having the following features: adjustable weight, loft, lie, and shaft length. In addition, it is an object of this invention to improve the "feel" of the golf putter by providing a bonded rubber coating to the striking face of the putter.

It is to be pointed out that in regulation golf play, the golfer is prohibited, by current regulations, from changing the configuration of the putter once play has been initiated. However, even with such a restriction, a golfer using my present invention will enjoy substantial advantages in that he or she will be able to configure the golf putter to meet the particular course and current grounds conditions before regulation play begins.

DISCLOSURE OF THE INVENTION

These objects are achieved through use of an adjustable golf putter which is provided with an adjustable head assembly, hosel, shaft and face plate. In the preferred embodiment, a plurality of shafts of various lengths can be selected to closely conform to the requirements for a golfer of any particular height.

The putter head assembly is formed of a putter head body which is either cast or forged from metal. To it is attached a face plate assembly which itself is formed of a metal plate encased by bonding rubber or other resilient material around it. The weight of the putter becomes adjustable by varying the mass of the metal plate. The loft of the striking surface of the face plate is variable by selection of alternative face plate configurations.

The hosel is designed to incorporate either a left handed or right handed lie, and is pivotally adjustable relative to the putter head body to adjust the lie of the putter head.

The adjustment features of this new putter can be used to advantage by a recreational golfer, or even a tournament play golfer in preparing for tournament play. The adjustments made to the putter by golfers can then be easily and quickly sealed in place by use of conventional household products, such as fingernail polish, to provide a putter which becomes non-adjustable during tournament play. In this manner, the tournament player can, prior to the tournament, reconfigure the putter to meet particular course and play conditions, which can then be sealed for regulation use and play.

BEST MODE FOR CARRYING OUT INVENTION

Figure 1:
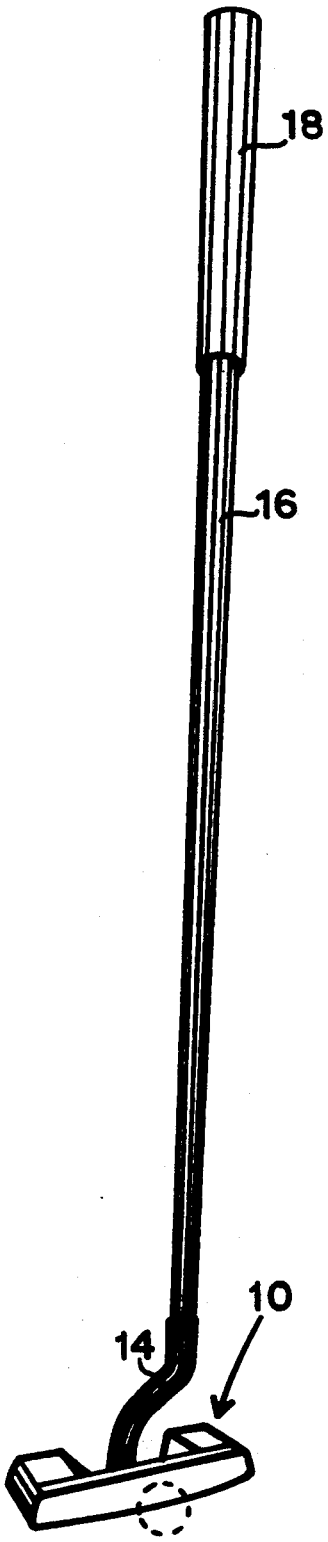
FIG. 1 is a perspective representational view of my new golf putter.

Referring to FIGS. 1 through 8, there is shown a preferred embodiment for my adjustable golf putter 10. As shown in FIG. 1, it is provided with adjustable putter head assembly 12, hosel 14, shaft 16, and grip 18. In the preferred embodiment, the shafts 16 of different lengths can be used to compensate for varying heights of golfers. Alternatively, hosel 14 could be eliminated and shaft 16 attached directly to putter head assembly 12.

Figure 2:
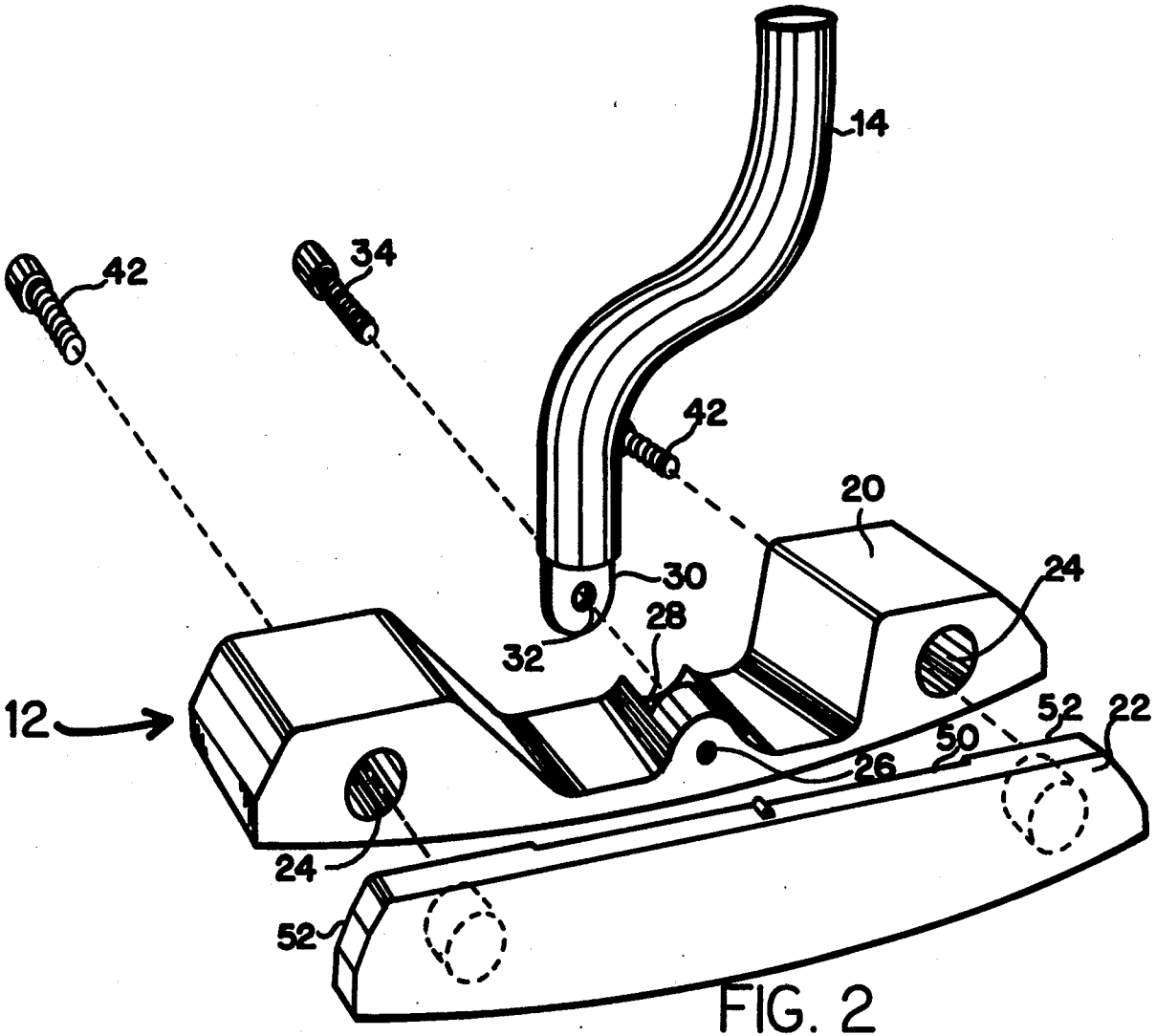
FIG. 2 is an exploded perspective representational view showing the various components of the head assembly.
Figure 3:
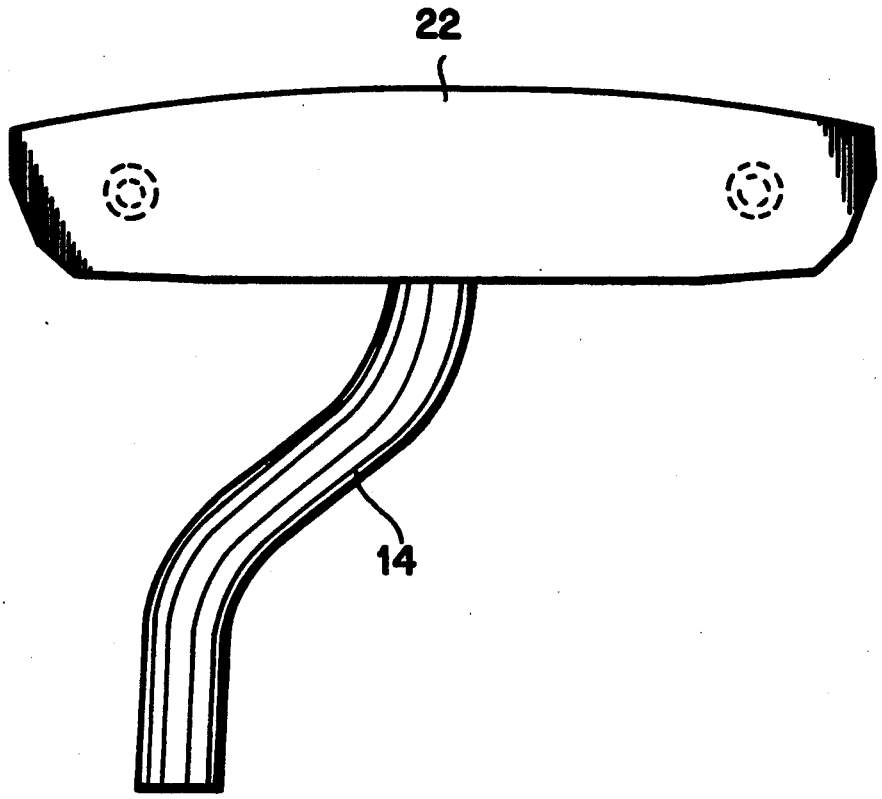
FIG. 3 is a front view of the adjustable golf putter.
Figure 4:
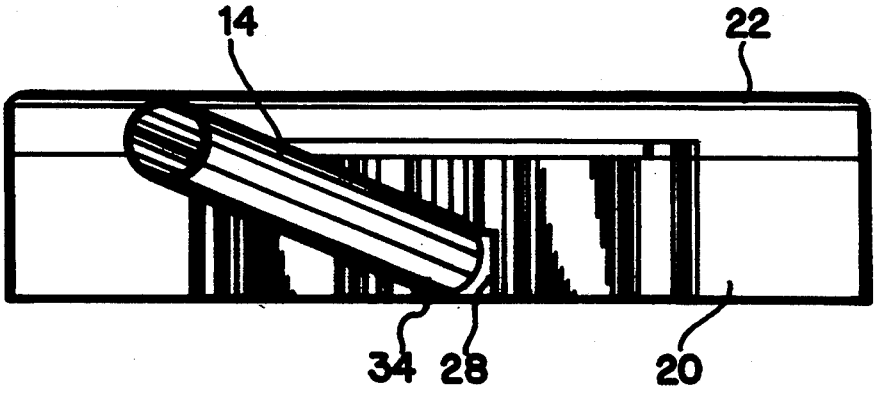
FIG. 4 is a top view of the adjustable golf putter.
Figure 8:
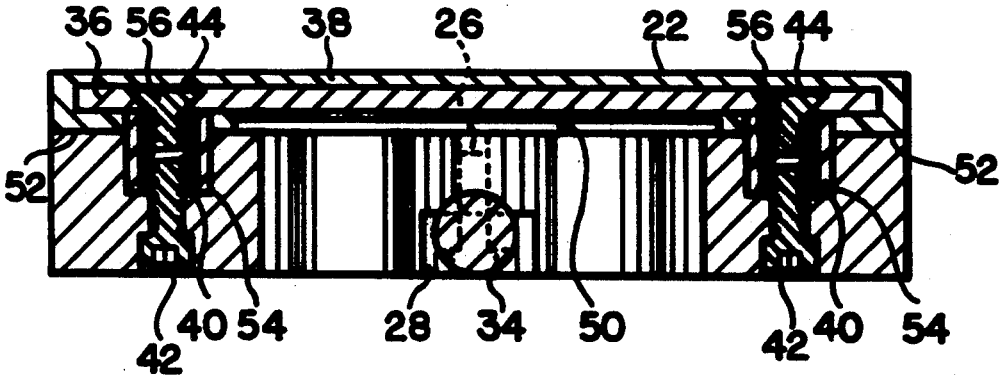
FIG. 8 is a sectional bottom view of the adjustable golf putter taken along section lines 8.

As shown in FIG. 2, head assembly 12 is formed of putter head body 20 which can be either cast or forged, and in the preferred embodiment is formed of metal, to which is attached face plate assembly 22, by means of screws 42 which pass through holes 24 in body 20, and threadedly engage within threaded holes 44 formed within metal plate 36 as shown in FIG. 8.

Formed integral with body 20 is a shaft attachment plate receiving means or hosel receiving assembly 28 and threaded hosel attachment hole 26. The receiving assembly 28 is designed to allow pivotal, lie adjustable engagement of putter head body 20 to hosel 14 by use of threaded hosel attachment screw 34 which interfits through hosel hole 32 in a shaft attachment plate comprising a hosel attachment plate 30 to engage within threaded attachment hole 26 of body 20.

In the preferred embodiment, the hosel is designed to be adjustable to either incorporate a left handed lie or a right handed lie, depending upon the preferences of the particular golfer. To achieve this, hosel attachment plate 30 is double sided, such that it can be flipped over to engage on one side or the other, changing from left handed to right handed operation, or vice versa.

Figure 5:
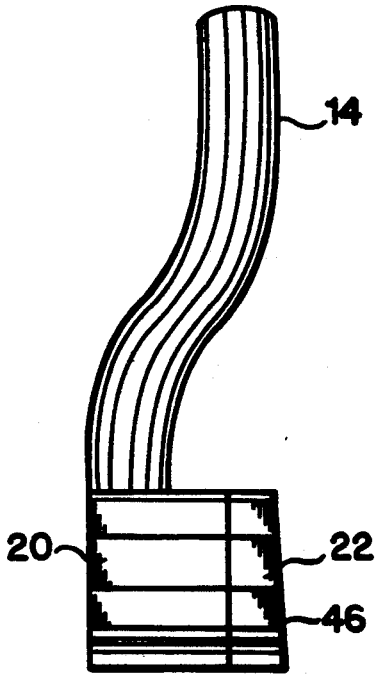
FIG. 5 is a first side view of the adjustable golf putter disclosing a positive loft for the face plate.
Figure 6:
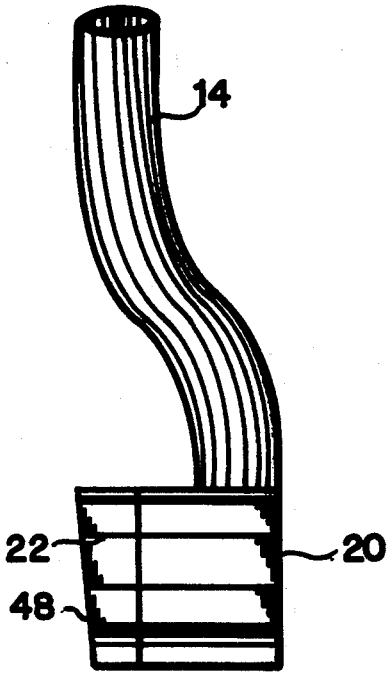
FIG. 6 is a second side view of the adjustable golf putter showing a negative loft for the face plate of the adjustable golf putter.

Face plate assembly 22 is interchangeable with additional face plate assemblies to allow for neutral, positive or negative loft. FIG. 5 discloses a positive loft, striking surface 46 and FIG. 6 a negative loft striking surface 48. While the present preferred embodiment discloses a non-symmetrical shape for putter head body 20, it should be apparent to those skilled in the art that if a symmetrical body 20 is provided, then only one face plate assembly 22 need be provided, which could be attached to selectively provide either positive or negative loft with a single unit.

Figure 7:
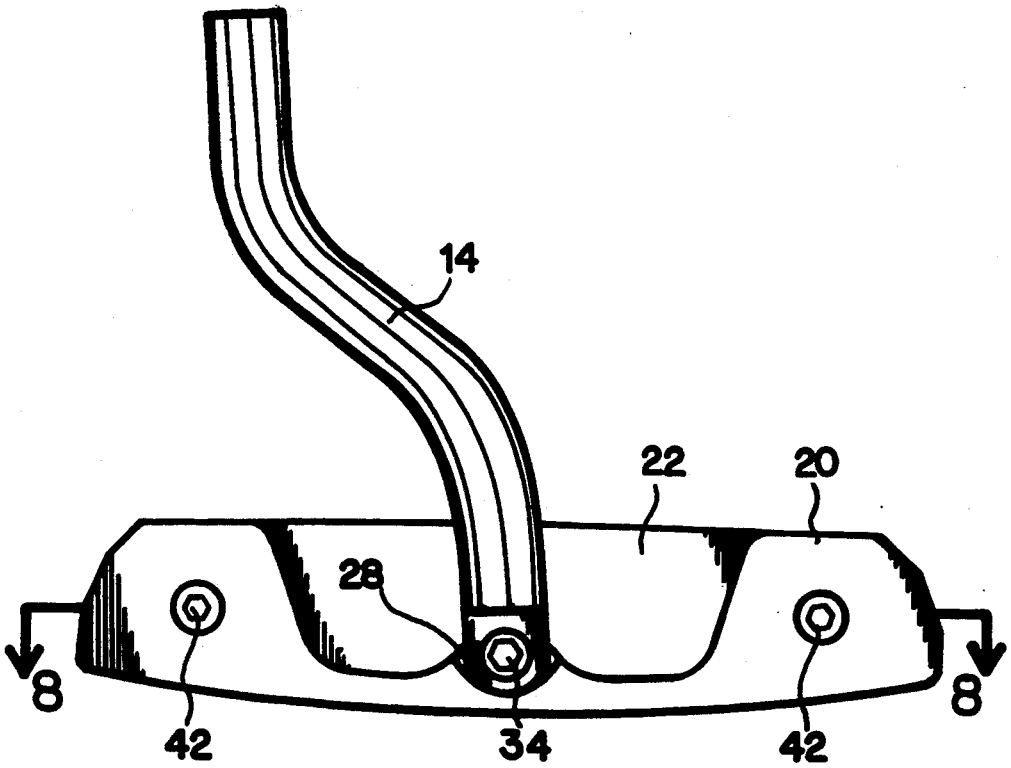
FIG. 7 is a rear view of the adjustable golf putter.

FIG. 8, which is a sectional bottom view taken along sectional line 8 from FIG. 7, discloses the configuration of face plate assembly 22. As can be seen, face plate assembly 22 is formed of rubber which encases, and is bonded to, metal plate 36. A plurality of different face plates 22 can be provided, each with a different thickness and mass for metal plate 36 to adjust the weight of the putter over a considerable range of selectable weights. Bonded rubber 38 encases metal plate 36. As can be seen in FIGS. 2 and 8, the rubber 38, bonded to metal plate 36, is configured to form two engagement surfaces 52, and a central slot 50 in face plate assembly 22. While slot 50 may or may not be of any functional significance in use to strike a golf ball, it is helpful in that this configuration, which utilizes engagement pads 52, provides positive engagement surfaces for face plate assembly 22, even if there are minor imperfections in the casting which forms putter head body 20 or in face plate assembly 22.

Interconnection and alignment of face plate assembly 22 to putter body 20 is accomplished by use of threaded bushings 40, flat head screws 56 and screws 42. Threaded bushings 40 are themselves encased, around the sides with bonded rubber bushing encasements 54 and attached to metal plate 36 by means of flat head screws 56. Bushings 40 interfit within holes 24 and are held by means of screws 42. Bonded rubber bushing encasements 54 serve to help hold face plate assembly 22 in proper alignment and to improve the feel of the putter when in use.

Bonded rubber 38 is only one of a number of suitable resilient materials which can be bonded to metal plate 36, and serves two functions, the first to improve the "feel" of the putting stroke, and secondly to provide more control over the golf ball by enabling the golfer to have more control over the initiation of either forward roll or backspin, and to enable the golfer to make minute adjustments in the angle of travel for the golf ball as the golfer follows through with the putting stroke.

For purely recreational golf, or for practice in preparation for tournament golf played under golfing association rules, it may be desirable for the golfer using my new adjustable putter 10 to experiment with different configurations such as loft, weight, lie and length. However, in tournament play, the rules are that a golf club taken out on to the course during play, may not be modifiable or adjustable during the tournament. For that reason, as shown in FIGS. 2 and 8, screws 42 are formed with counter-sunk driver receiving slots, and are counter sunk into putter head body 20. The purpose of this is to facilitate temporary chemical sealing or bonding, to make the putter head non-adjustable once tournament play begins. This can be accomplished simply, for example, by backfilling behind screws 42, some of the counter sunk portions of holes 24 in putter head body 20 with a household item, such as fingernail polish. In this manner, screws 42 can be sealed in an engaged configuration to prevent further adjustment of putter 10 during tournament play. The same can be accomplished for hosel 14 by either sealing the hosel attachment plate 30 to putter head body 20, or attachment screw 34 to body 20 and/or shaft attachment plate 30.

Thus, in the present preferred embodiment, provision is made for the adjustable golf putter to be adjustable within the following parameters: shaft length, putter weight, putter lie, and putter loft, all of which can be preset by the golfer depending upon course and conditions, before the initiation of regulation play. In addition, the present preferred embodiment of the adjustable putter 10 also provides for improved feel and control of the putter in use.

While there is shown and described the present preferred embodiment of the invention, it is to be distinctly understood that this invention is not limited thereto but may be variously embodied to practice within the scope of the following claims.

I claim:

1. A golf putter which comprises:

a golf club shaft having a first end;

a putter head body having a front surface;

a face plate assembly for removable attachment to the front surface of the putter head body, said face plate assembly having a metal plate encased within, and bonded to, an encasement of resilient material, said resilient material further having a striking surface in spaced relationship with the front surface of the putter head body;

means for removably attaching the face plate to the putter head body; and means for adjustably attaching the first end of the shaft to the putter head body.

2. The golf putter of claim 1 wherein the mass of the metal plate encased within the face plate is of a selectable, predetermined mass.

3. The golf putter of claim 1 wherein the striking surface of the resilient material is of a preselectable loft angle.

4. The golf putter of claim 3 wherein the striking surface of the resilient material is of a preselectable positive loft angle.

5. The golf putter of claim 3 wherein the striking surface of the resilient material is of a preselectable negative loft angle.

6. The golf putter of claim 1 wherein the means for adjustably attaching the first end of the shaft to the putter head body further comprises:

a shaft attachment plate attached to and extending from the first end of the shaft for pivotally adjustable angle of engagement attachment with a shaft attachment plate receiving means attached to the putter head body, to adjust the lie of said putter head body relative to the shaft; and shaft face receiving means attached to the putter head body for receiving and holding said shaft attachment plate receiving means in engagement with the putter head body.

7. The golf putter of claim 1 wherein the means for adjustably attaching the first end of the shaft to the putter head body further comprises:

a shaft attachment plate attached to and extending from the first end of the shaft, said shaft attachment plate having a pair of opposing faces, each for selectable, pivotal and adjustable angle of engagement attachment with a shaft attachment plate receiving means attached to the putter head body, to adjust both the direction of extension of the shaft from the putter head body and the lie of said putter head body relative to the shaft; and said shaft attachment plate receiving means attached to the putter head body for receiving and holding said shaft attachment plate in engagement with the putter head body.

8. A golf putter which comprises:

a golf club shaft having a first end;

a putter head body having a front surface;

a face plate assembly for removable attachment to the front surface of the putter head body, said face plate assembly having a metal plate of a selectable predetermined mass encased within, and bonded to, an encasement of resilient material, said resilient material further having a striking surface of preselectable loft angle in spaced relationship with the front surface of the putter head body;

means for removably attaching the face plate to the putter head body;

a shaft attachment plate attached to and extending from the first end of the shaft for pivotally adjustable angle of engagement attachment with a shaft attachment plate receiving means attached to the putter head body to adjust the lie of said putter head body relative to the shaft; and said shaft attachment plate receiving means attached to the putter head body for receiving and holding said shaft attachment plate in engagement with the putter head body.

9. A golf putter which comprises:

a golf club shaft having a first end;

a putter head body having a front surface;

a face plate assembly for removable attachment to the front surface of the putter head body, said face plate assembly having a metal plate of a selectable predetermined mass encased within, and bonded to, an encasement of resilient material, said resilient material further having a striking surface of preselectable loft angle in spaced relationship with the front surface of the putter head body;

means for removeably attaching the face plate to the putter head body;

a shaft attachment plate attached to and extending from the first end of the shaft, said shaft attachment plate having a pair of opposing faces, each for selectable, pivotal and adjustable angle of engagement attachment with a shaft attachment plate receiving means attached to the putter head body, to adjust both the direction of extension of the shaft from the putter head body and the lie of said putter head body relative to the shaft; and said shaft attachment plate receiving means attached to the putter head body for receiving and holding said shaft attachment plate in engagement with the putter head body.

* * * * *